United States Patent [19]

Otto et al.

[11] Patent Number: 4,765,503

[45] Date of Patent: Aug. 23, 1988

[54] REFUSE BIN WITH DOWNWARDLY OPEN RECEIVING ENGAGEMENT OF A GRIPPER

[76] Inventors: Werner Otto, Forstweg 2, D 5910 Kreuztal; Ulrich Beese, Brunnenstrasse 6, D 5963 Wenden-Hüsborn, both of Fed. Rep. of Germany

[21] Appl. No.: 138,099

[22] Filed: Dec. 28, 1987

[30] Foreign Application Priority Data

Feb. 2, 1987 [DE] Fed. Rep. of Germany ..... 3703034

[51] Int. Cl.[4] ..... B65D 43/00

[52] U.S. Cl. ..... 220/74; 220/1 T

[58] Field of Search ..... 220/1 T, 1.5, 72, 74, 220/94 A; 414/408

[56] References Cited

U.S. PATENT DOCUMENTS

| | | | |
|---|---|---|---|
| 3,529,743 | 9/1970 | Ehrbar et al. | 220/74 |
| 3,811,597 | 5/1974 | Frankenberg et al. | 220/94 A X |
| 4,450,976 | 5/1984 | Snyder et al. | 220/1 T X |
| 4,613,271 | 9/1986 | Naab | 414/408 X |
| 4,648,522 | 3/1987 | Wise | 220/1 T X |
| 4,673,327 | 6/1987 | Kanpp | 414/408 |
| 4,687,405 | 8/1987 | Olney | 220/1 T X |
| 4,726,726 | 2/1988 | Dossena et al. | 414/408 |

*Primary Examiner*—Steven M. Pollard

*Attorney, Agent, or Firm*—Paul L. Sjoquist

[57] ABSTRACT

In a refuse bin comprising a body portion and a hinged lid the body portion is provided on its front wall opposite the lid hinges with a receiving pocket for the engagement of a gripper of a lift-tip apparatus and the rear wall of the receiving pocket extends outwardly wedge-like in inclined manner or rounded in dome-manner, the receiving pocket consisting of at least two wall portions which extend approximately parallel to each other and which are connected together by struts.

8 Claims, 1 Drawing Sheet

REFUSE BIN WITH DOWNWARDLY OPEN RECEIVING ENGAGEMENT OF A GRIPPER

The invention relates to a refuse bin comprising a body part of substantially rectangular cross-section and a hinged lid, the body part being provided on its front wall opposite the lid hinges with a downwardly open receiving pocket for engagement of a gripper of a lift-tip apparatus and the rear wall of the receiving pocket extending outwardly in wedge-manner inclined or rounded dome-like.

DE-GM No. 8,519,096.9 discloses such a refuse bin. The pickup or receiving pocket is provided with a centre upwardly pointing rounded tip whose front wall facing the refuse bin is substantially planar. Since the pickup or receiving pocket during the lifting and tipping movement has to take up practically the entire load of the full refuse bin and also is subjected to shaking and vibrating motions in the end phase of the tip position, in many cases the thin-walled receiving pocket has proved inadequate; the life of the entire bin is also shortened because in many cases damage occurs to the receiving pocket.

The invention is based on the problem of providing a receiving or pickup pocket for the aforementioned purpose which can be exposed even to extremely high loads and increases the life of the refuse bin.

This problem is solved in that according to the invention the receiving pocket is formed from at least two wall portions which extend approximately parallel to each other and which are connected together by struts. This doubling of the receiving pocket front wall with corresponding struts not only leads to strengthening of the receiving pocket but increases the life of the entire refuse bin because the life of such a bin depends essentially on the freedom from damage of the receiving or pickup pocket.

The struts and/or reinforcements may be in the form of honeycombs. The openings of the honeycombs extend parallel to the front wall of the receiving pocket. The surface of the wall portions is preferably made strip-like at least in the region remote from the free edge. This strip-like configuration leads to fluting in the vertical direction. Preferably, the strips have the same width but different depth.

The surface of the wall portions is preferably made free from interruptions in the region of the free edge of the receiving means. The total thickness of the wall portions can increase from their side edges to the centre. The honeycombs can have in cross-section the form of rhombuses or semi-rhombuses.

An example of embodiment of the invention is illustrated in the drawings and will be explained in detail hereinafter. In the drawings.

Figure 1:
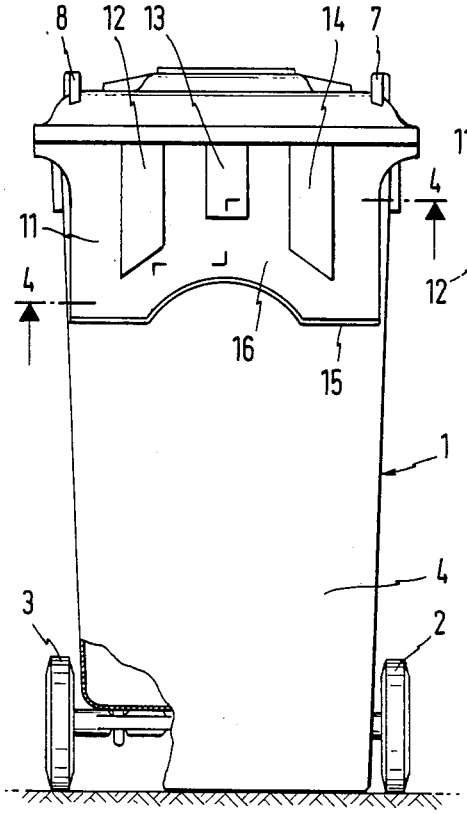
FIG. 1 is a view of the front side of a refuse bin.
Figure 2:
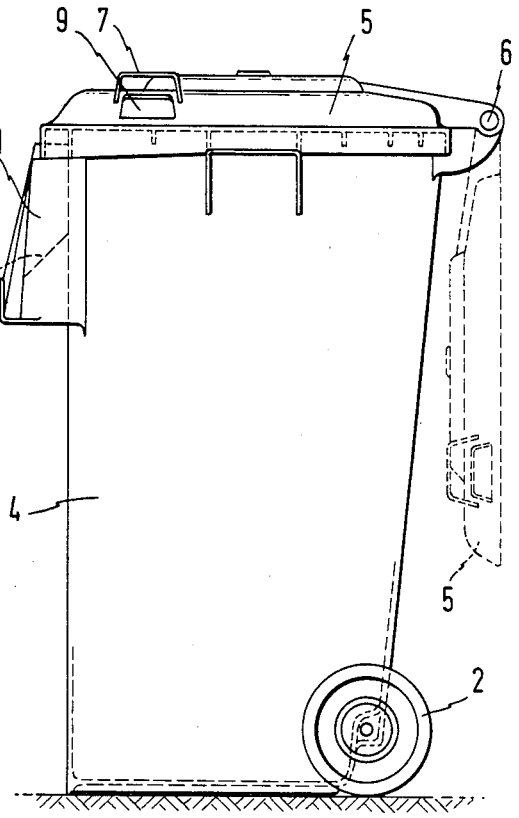
FIG. 2 is a side elevation of the same refuse bin.

A refuse bin 1 of plastic and of approximately rectangular cross-section with a capacity of 240 l comprises two wheels 2 and 3 on a body part 4. The refuse bin is provided with a hinged lid 5 which can be pivoted about a hinge pin 6.

The lid 5 comprises two grips 7 and 8 and correspondingly associated grip dishes 9 and 10.

The body part has at its front wall opposite the hinge pin 6 a pickup or receiving pocket 11 which for shaking is cut out for receiving a gripper claw which engages from below in such a manner that the gripper claw, not shown, engages behind the receiving pocket and comes into engagement with the rear wall 12 of the receiving pocket indicated in dashed line.

The front wall of the receiving pocket 11 is provided with equiwidth strips 12, 13 and 14 made as rearward projections (FIG. 4) but extending along only about ⅓ to ½ of the corresponding height of the receiving pocket. In the region facing the free edge 15 of the receiving pocket 11 these strips are closed at the front so that a planar surface 16 results there.

Figure 4:
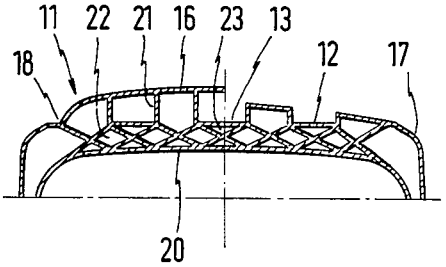
FIG. 4 is a section along the line 4—4 of FIG. 1.
Figure 3:
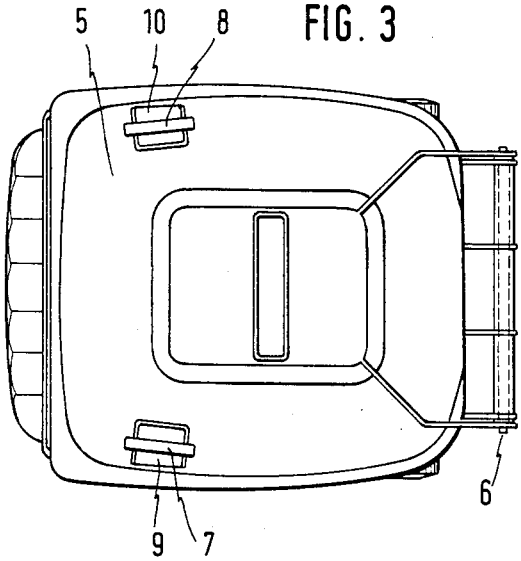
FIG. 3 is a plan view of the same refuse bin.

As apparent from FIG. 4 the rearwardly projecting strips 12, 13 and 14 are of the same width but of different depth.

Whereas in the upper region facing the lid the receiving pocket is rounded in the edge region 17, in the surface 16 in the lower region of the receiving pocket 11 a discontinuity 18 is provided.

The strips 12, 13 and 14 and the wall portions therebetween on the one hand and the wall portion 16 on the other result in the formation, approximately parallel to the continuous inner wall portion 20 of the receiving pocket, of a second wall portion which via struts or reinforcements is connected to said planar wall portion or stiffened.

These struts 21 can extend only on a partial region, i.e. the region 16, of the receiving pocket and run on the one hand in the vertical direction and on the other perpendicularly to the body part front wall.

Other struts may as illustrated in FIG. 4 be combined to give rhombic honeycombs and in addition to whole rhombuses 22 semi-rhombuses 23 may be provided.

We claim:

1. Refuse bin comprising a body part of substantially rectangular cross-section and a hinged lid, the body part being provided on its front wall opposite the lid hinges with a downwardly open receiving pocket for engagement of a gripper of a lift-tip apparatus and the rear wall of the receiving pocket extending outwardly in wedge-manner inclined or rounded dome-like, characterized in that the receiving pocket is formed from at least two wall portions which extend approximately parallel to each other and which are connected together by struts.

2. Refuse bin according to claim 1, characterized in that the wall portions in the region of the free edge of the receiving means comprise additional reinforcements.

3. Refuse bin according to claim 1 or 2, characterized in that the struts and/or reinforcements are made in the form of honeycombs.

4. Refuse bin according to any one of claims 1 to 3, characterized in that the surface of the wall portions are made strip-like at least in the region remote from the free edge.

5. Refuse bin according to claim 4, characterized in that the strips each have the same width but a different depth.

6. Refuse bin according to claim 4 or 5, characterized in that the surface of the wall portions is free of interruptions in the region of the free edge of the receiving means.

7. Refuse bin according to any one of claims 4 to 6, characterized in that the total thickness of the wall portions increases from the side edges thereof to the centre.

8. Refuse bin according to any one of claims 3 to 7, characterized in that the honeycombs have in cross-section the form of rhombuses or semi-rhombuses.

* * * * *